US006963650B2

(12) United States Patent
Combest

(10) Patent No.: US 6,963,650 B2
(45) Date of Patent: Nov. 8, 2005

(54) COAXIAL SPEAKER WITH STEP-DOWN LEDGE TO ELIMINATE SOUND WAVE DISTORTIONS AND TIME DELAY

(75) Inventor: Christopher Combest, Leawood, KS (US)

(73) Assignee: Multi Service Corporation, Overland Park, KS (US)

( * ) Notice: Subject to any disclaimer, the term of this patent is extended or adjusted under 35 U.S.C. 154(b) by 430 days.

(21) Appl. No.: 10/238,403

(22) Filed: Sep. 9, 2002

(65) Prior Publication Data

US 2004/0047478 A1 Mar. 11, 2004

(51) Int. Cl.[7] ..... H04R 25/00

(52) U.S. Cl. ..... 381/182; 381/184; 381/186; 381/401

(58) Field of Search ..... 381/87, 182, 184, 381/186, 335, 396, 401

(56) References Cited

U.S. PATENT DOCUMENTS

| | | | | |
|---|---|---|---|---|
| 2,496,589 A | * | 2/1950 | Firth | 381/186 |
| 3,796,839 A | * | 3/1974 | Torn | 381/432 |
| 3,816,672 A | * | 6/1974 | Gefvert et al. | 381/352 |
| 4,008,374 A | * | 2/1977 | Tiefenbrun | 381/89 |
| 4,167,985 A | | 9/1979 | Dunlavy | |
| 4,284,844 A | | 8/1981 | Belles | |
| 4,322,578 A | | 3/1982 | Selmin | |
| 4,381,831 A | | 5/1983 | Putnam | |
| 4,437,541 A | | 3/1984 | Cross | |
| 4,554,414 A | | 11/1985 | House | |
| 5,513,270 A | | 4/1996 | Lewis | |
| 5,526,456 A | * | 6/1996 | Heinz | 381/340 |
| 5,568,562 A | * | 10/1996 | Huang | 381/186 |
| 5,848,173 A | | 12/1998 | Sato et al. | |
| 5,991,425 A | | 11/1999 | Anagnos | |
| 6,026,927 A | | 2/2000 | Burdett et al. | |
| 6,031,920 A | | 2/2000 | Wiener | |
| 6,070,694 A | | 6/2000 | Burdett et al. | |
| 6,257,365 B1 | | 7/2001 | Hulsebus, II | |

FOREIGN PATENT DOCUMENTS

| | | |
|---|---|---|
| JP | 6178387 | 6/1994 |
| JP | 6178388 | 6/1994 |
| JP | 6315194 | 11/1994 |

* cited by examiner

*Primary Examiner*—Curtis Kuntz
*Assistant Examiner*—Phylesha Dabney
(74) *Attorney, Agent, or Firm*—Hovey Williams LLP

(57) ABSTRACT

A coaxial speaker assembly (10) with reduced sound distortion, sound time delay, and polar response distortion. The coaxial speaker assembly (10) includes a high-frequency speaker system (16) mounted coaxially with and fitting within a lower-frequency speaker system (14). A baffle (50) is secured to a diaphragm (48) of the high-frequency speaker system (16). A step-down ledge (52) is circumferentially positioned adjacent to the baffle (50) and extends outwardly therefrom. A portion of the sound waves emanating from the high-frequency diaphragm (48) are reflected off the step-down ledge (52).

12 Claims, 1 Drawing Sheet

Figure 1:
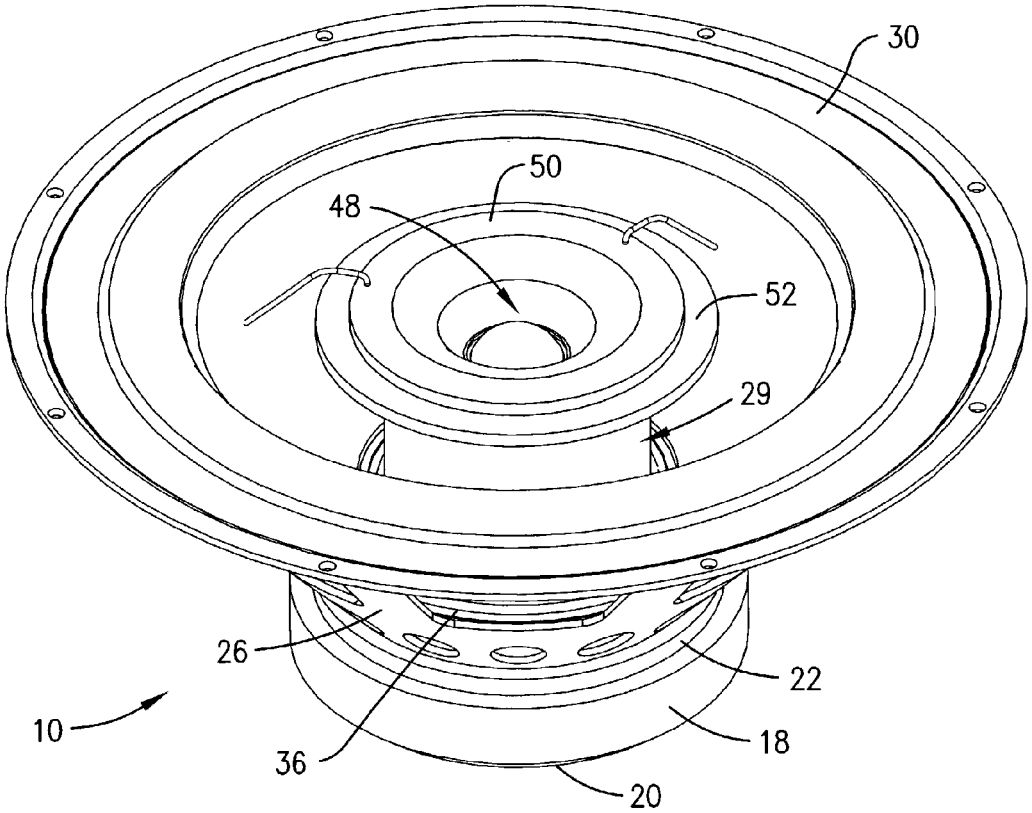

COAXIAL SPEAKER WITH STEP-DOWN LEDGE TO ELIMINATE SOUND WAVE DISTORTIONS AND TIME DELAY

BACKGROUND OF THE INVENTION

1. Field of the Invention

The present invention relates to coaxial speakers and more particularly, a coaxial speaker assembly that reduces sound distortion, sound time delay, and improves polar response. The coaxial speaker assembly of the present invention includes a step-down ledge positioned adjacent to a baffle for reflecting sound waves diffracting around the baffle.

2. Description of the Prior Art

Commonly, a coaxial speaker assembly is broadly comprised of a high-frequency speaker, such as a tweeter, fitted within a lower-frequency speaker, such as a woofer, wherein both speakers lie on a common axis. The high-frequency speaker often has a baffle circumferentially positioned around a high-frequency diaphragm. The baffle serves two purposes: (1) to direct sound waves emanating from the high-frequency diaphragm out towards a listener; and (2) to prevent mixing of the sound waves emanating from the high-frequency diaphragm and an underlying low-frequency diaphragm.

The baffle is limited, though, in the sound waves it can direct. In operation, most of the sound waves project outwards such that the listener hears the high-frequency waves without sound distortion or sound time delay. However, a portion of the sound waves diffract around an edge of the baffle and downwards toward the moving low-frequency diaphragm. These waves are then reflected off the moving low-frequency diaphragm and back out towards the listener. A first problem resulting from reflection off the low-frequency diaphragm is sound distortion due to a frequency shift of the low-frequency sound waves. Because the low-frequency diaphragm is moving, the waves reflecting off the diaphragm undergo a frequency shift, similar to a Doppler effect, which produces the distorted sound. Second, the time necessary for the sound waves to travel down towards the low-frequency diaphragm and back out towards the listener results in the sound waves not being heard at the correct time. A third problem arises due to the low-frequency diaphragm being positioned at an angle that results in sound wave reflection at an undesirable angle, thus distorting polar response. Polar response is a measurement of how the sound waves produced by a speaker sound, i.e., its tonal characteristics, in relation to where a listener is standing in a room.

To remedy sound distortion, sound time delay, and polar response distortion due to reflection at an undesirable angle, common prior art devices round off or bevel, the baffle's edge. The baffle's edge may also have an included angle, depending on the size and style of the speaker. Unfortunately, none of these devices sufficiently reduces sound distortion, sound time delay, and polar response distortion.

There is therefore a need for an improved coaxial loudspeaker assembly that does not suffer from the limitations of conventional coaxial speaker assembly designs.

SUMMARY OF THE INVENTION

The present invention solves the above-described problems and provides a distinct advance in the art by providing a coaxial speaker assembly that does not suffer from sound distortion, sound time delay, or polar response distortion. The coaxial speaker assembly of the present invention broadly comprises a first speaker system, such as a woofer speaker system; a second speaker system, such as a tweeter speaker system, fitted within the first speaker system; a baffle for directing sound waves produced by the second speaker system; and a step-down ledge for reflecting a portion of the sound waves produced by the second speaker system.

In accordance with the present invention, the step-down ledge is positioned adjacent to or secured to the baffle and projects outwardly therefrom. When a portion of high-frequency sound waves directed along the baffle diffracts around an edge of the baffle and down towards a second speaker system diaphragm, the step-down ledge reflects the sound waves back out towards the listener. The step-down ledge thus limits sound distortion, sound time delay, and an undesirable angle of reflection by forcing the high-frequency waves to reflect off the step-down ledge instead of the second speaker system diaphragm.

BRIEF DESCRIPTION OF THE DRAWING FIGURES

Figure 2:
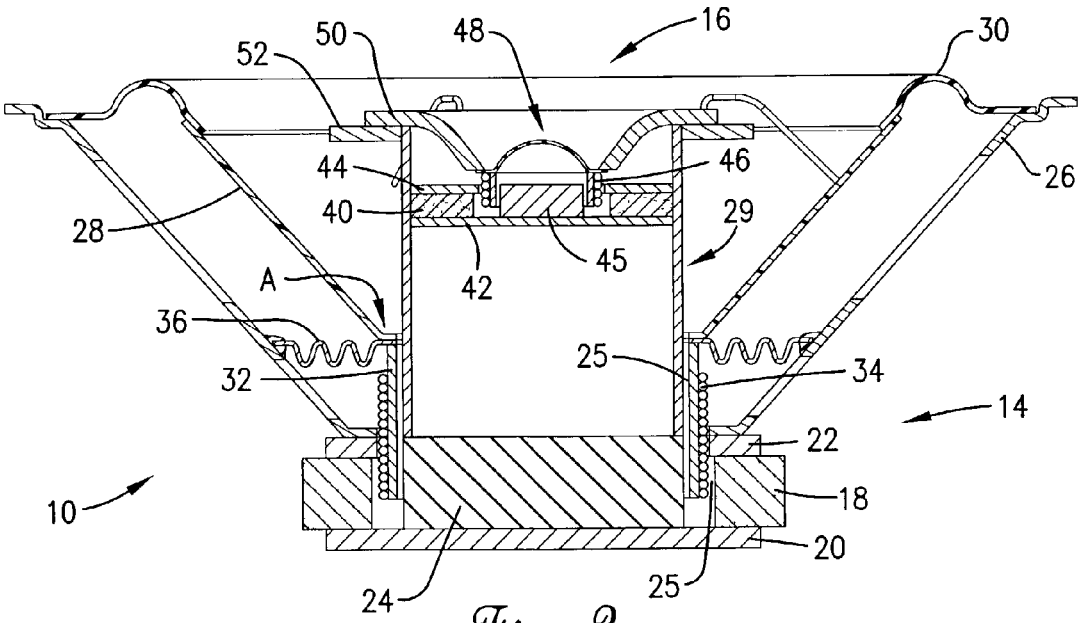

A preferred embodiment of the present invention is described in detail below with reference to the attached drawing figures, wherein:

FIG. 1 is a perspective view of the coaxial speaker assembly, particularly illustrating a baffle and a step-down ledge and constructed in accordance with a preferred embodiment of the present invention; and FIG. 2 is a vertical cross-sectional view of a coaxial speaker assembly.

DETAILED DESCRIPTION OF THE PREFERRED EMBODIMENT

Referring to FIGS. 1 and 2, a coaxial speaker assembly 10 constructed in accordance with a preferred embodiment of the present invention is illustrated. As best illustrated in FIG. 2, the coaxial speaker assembly 10 broadly comprises a first speaker system 14, such as a woofer speaker system, for producing low-frequency sound waves; and a second speaker system 16, such as a tweeter speaker system, for producing high-frequency sound waves.

The first speaker system 14 comprises a permanent magnet 18; a bottom plate 20 and a top plate 22; a circularly-shaped block 24; a conically-shaped frame 26; a diaphragm 28; a cylindrically-formed center pole 29; a suspension edge 30; a voice coil former 32; a voice coil 34; and an accordion edge suspension device 36.

The permanent magnet 18 is preferably doughnut-shaped having a circularly-shaped open area and is preferably made of a permanent magnet material, such as neodymium or ferrite. The permanent magnet 18 is encased between the circularly-shaped bottom plate 20 and the doughnut-shaped top plate 22 having a circularly-shaped open area. Both the bottom and tope plates 20, 22 are made of a highly permeable iron.

The circularly-shaped block 24 is positioned within the circularly-shaped open area of the permanent magnet 18. The block 24 is preferably made of a magnetic material, such as iron. A portion of the voice coil former 32, as described below, is positioned between the block 24 and the magnet 18, such that a small air gap 25 is formed between the block 24 and the voice coil former 32. Together, the permanent magnet 18, the bottom and top plates 20,22, and the block 24 generate a magnetic field across the air gap 25.

The conically-shaped frame 26 is secured to the top plate 22 and extends upwardly therefrom. The frame 26 is preferably made of steel or other suitable rigid material.

The diaphragm 28, also known in the art as a cone, is conically-shaped and fits within the conically-shaped frame 26. The diaphragm 28 can be made of a variety of materials, but is preferably made of polypropylene or paper. A suspension edge 30 is attached to an outer periphery of the diaphragm 28 and to an inner periphery of the frame 26 to retain the diaphragm 28 within the frame 26. The suspension edge 30 is preferably made of a rubber material or other suitable flexible material.

A cylindrically-formed center pole 29 is centrally positioned on the block 24 and extends upwardly therefrom. The center pole 29 is preferably made of a non-magnetic material, such as aluminum. The center pole 29 houses several components of the second speaker system 16, as described below.

The hollow, cylindrically-shaped voice coil former 32 is proximately positioned around a lower portion of the center pole 29 and an upper portion of the block 24. The voice coil former 32 preferably extends upwards beyond the block 24 to a height such that the voice coil former 32 is attached to a lower end of the diaphragm 28, noted as location "A" in FIG. 2. The voice coil former 32 is preferably made of a non-magnetic material, such as polypropylene or cardboard.

The voice coil 34 is a length of electrically conductive wire, preferably copper, wound on a portion of an outside perimeter of the voice coil former 32 and operable to carry an electrical current from a signal source. As understood in the art, when the electrical current is run through the voice coil 34, a magnetic field is produced. A portion of the voice coil 34 is positioned proximately adjacent to the permanent magnet 18 and the permanent magnet's magnetic field. When the magnetic field of the permanent magnet 18 interacts with the magnetic field produced by the voice coil 34, the voice coil 34 moves in a generally vertical direction, which causes the voice coil former 32 to move vertically. This then causes the diaphragm 28 to move vertically. The vertical movement of the diaphragm 28 produces the acoustical waves that correspond to sounds, such as low-frequency sounds.

A first end of the doughnut-shaped accordion edge suspension device 36 is secured to the frame 26, and a second end of the suspension device 36 is secured to the position A where the voice coil former 32 and the diaphragm 28 are attached, as illustrated in FIG. 2, such that the suspension device 36 lies in a plane parallel to a plane horizontally passing through the permanent magnet 18. The suspension device 36 assists in stabilizing and positioning the diaphragm 28 and the voice coil former 32, while still allowing the voice coil former to move freely, as described above. Known in the art as a spider, the suspension device 36 is preferably made of a flexible material, such as impregnated cloth.

The second speaker system 16 is positioned coaxially with the first speaker system 14 and within the frame 26. The operation of the second speaker system 16 is substantially similar to the operation of the first speaker system 14. The second speaker system 16 comprises a permanent magnet 40; a bottom plate 42; a top plate 44; a circularly-shaped block 45; a voice coil 46; a diaphragm 48; a baffle 50; and a step-down ledge 52.

The permanent magnet 40 is preferably doughnut-shaped having a circularly-shaped open area. The block 45, preferably made of iron or other magnetic material, is positioned within the open area of the magnet 40, such that an air gap is formed between the block 45 and the magnet 40. The magnet 40 and block 45 are encased between the bottom and the top plates 42, 44, which are positioned within an upper portion of the center pole 29. Similar to the permanent magnet 18 of the first speaker system 14, the permanent magnet 40 of the second speaker system 16 produces a magnetic field.

Positioned between the block 45 and the magnet 40 is the voice coil 46. The voice coil 34 of the first speaker system and the voice coil 46 of the second speaker system 14 are preferably connected to a crossover circuit that directs low frequencies to the first speaker system 14 and high frequencies to the second speaker system 16.

The diaphragm 48 is proximately positioned above top plate 44 and housed within the center pole 29. The diaphragm 48 is preferably dome-shaped or convex, with the apex of the dome facing upward, but the diaphragm 48 may have a different shape, such as concave.

As best illustrated in FIG. 1, circumferentially positioned around the diaphragm 48 and radiating upwardly therefrom is the baffle 50, which directs the acoustical waves emanating from the diaphragm 48. The baffle 50 is preferably made of a rigid plastic or steel. Preferably, the baffle 50 is conically-shaped, which is known in the art as a horn-loaded baffle, but the baffle 50 may be differently shaped, such as flat. An outer edge of the baffle 50 is preferably one-fourth inch thick, but the thickness may range between one-eighth inch and one-half inch. The outer edge has an upper face and a lower face, wherein the lower face is directed towards the first speaker system 14.

In accordance with the preferred embodiment of the invention, the step-down ledge 52 is positioned adjacent to or secured to the lower face of the outer edge of the baffle 50. The step-down ledge 52 preferably extends outwardly from the baffle 50 a width of one-half inch, but the width may range between one-fourth inch and two inches. The step-down ledge 52 is preferably made of the same material as the baffle 50, such as rigid plastic or steel.

When acoustical waves emanating from the diaphragm 48 are directed along the baffle 50, most of the waves project out towards a listener. However, a portion of the waves diffract around the baffle's edge 50, project down towards the diaphragm 28 of the first speaker system 14, reflect off the diaphragm 28, and travel back up towards the listener. Because the diaphragm 28 is moving, as described above, the waves reflecting off the diaphragm 28 undergo a frequency shift, similar to a Doppler effect, which produces distorted sound. Additionally, the time necessary for the waves to travel down towards the diaphragm 28 and back up towards the listener results in a sound time delay. The high-frequency waves produced by the second speaker system 16 also reflect off the diaphragm 28 at an undesirable angle, which results in poor polar response. The step-down ledge 52 remedies these problems by forcing the waves diffracting around the baffle 50 to reflect off the step-down ledge 52 and back out towards the listener at a desirable angle and without reflecting off the low-frequency diaphragm 28.

From the preceding description, it can be seen that the coaxial speaker assembly 10 of the present invention allows for less time delay and distortion of acoustical waves emanating from the diaphragm 48. Although the invention has been described with reference to the preferred embodiment illustrated in the attached drawings, equivalents may be employed and substitutions made herein without departing from the scope of the invention recited in the claims. For example, although the preferred embodiment of the invention has been described as a coaxial speaker assembly 10 comprising a first speaker system 14, such as a woofer speaker system, and a second speaker system 16, such as a tweeter speaker system, the speaker systems may be any different speaker systems, including sub-woofers, midranges, or multiple speakers. Additionally, the frame 26 and the diaphragms of the various speaker systems may be formed in a variety of shapes, such as cylindrical or conical having included angles.

Another equivalent substitution may include a step-down ledge 52 that is operable to be positioned adjacent to the baffle 50 by the purchaser of the coaxial speaker assembly 10, as opposed to the step-down ledge 52 being secured to the baffle 50 in manufacture of the coaxial speaker assembly 10.

The step-down ledge 52 of the present invention is also operable to reflect sound waves diffracting around a variety of baffle edges, such as a straight edge, wherein a top surface of the baffle and the baffle's edge meet at a 90° angle, a beveled edge, a rounded edge, and an edge that has an included angle, wherein the top surface of the baffle and the baffle's edge meet at an angle such as 45°. Thus, the step-down ledge 52 may be used with a variety of speaker assemblies, given the many permutations of speaker systems, frames, diaphragm shapes, and baffle edges.

The diaphragm 48 of the second speaker system may also be driven by a means other than magnet 40 and voice coil 46, such as by piezoelectric means. Also, instead of the diaphragm 48, the second speaker system 16 may use alternative sources to produce high-frequency waves, such as a resonator plate excited by a piezoelectric material.

What is claimed is:

1. A coaxial speaker assembly comprising:

a first speaker system including— a permanent magnet for producing a magnetic flux, a voice coil, and a diaphragm driven by the voice coil; and a second speaker system coaxially aligned with the first speaker system and positioned within the first speaker system, the second speaker system including— a permanent magnet for producing a magnetic flux, a voice coil, a diaphragm driven by the voice coil, an arcuately-shaped baffle for directing a sound wave emanating from the diaphragm of the second speaker system, and a step-down ledge positioned adjacent to the baffle for reflecting sound waves diffracting around an edge of the baffle.

2. The coaxial speaker assembly as set forth in claim 1, the coaxial speaker assembly further comprising a frame which is substantially conical in shape.

3. The coaxial speaker assembly as set forth in claim 2, wherein the diaphragm of the first speaker system is substantially conical in shape.

4. The coaxial speaker assembly as set forth in claim 3, wherein the diaphragm of the first speaker system is secured to the frame using a suspension edge attached to an outer periphery of the diaphragm and an inner periphery of the frame.

5. The coaxial speaker assembly as set forth in claim 2, wherein an accordion edge suspension device is attached to a voice coil former to secure the voice coil of the first speaker system in position within the frame.

6. The coaxial speaker assembly as set forth in claim 1, wherein the diaphragm of the second speaker system is circumferentially surrounded by the baffle.

7. The coaxial speaker assembly as set forth in claim 6, wherein the baffle is conical in shape.

8. The coaxial speaker assembly as set forth in claim 1, wherein the step-down ledge projects outwardly from the baffle.

9. A speaker assembly including a baffle for directing sound waves produced by the speaker assembly and a step-down ledge positioned adjacent to the baffle and extending outwardly therefrom for reflecting sound waves diffracting around an edge of the baffle.

10. A coaxial speaker assembly comprising:

a first speaker system including— a permanent magnet for producing a magnetic flux, a substantially conically-shaped frame, a cylindrically-formed center pole, a cylindrically-shaped voice coil former positioned on a lower portion of a perimeter of the center pole, a voice coil wound on a perimeter of the voice coil former and operable to carry an electrical current from a signal source, a diaphragm which is substantially conically-shaped and driven by the voice coil, a suspension edge for securing the diaphragm to the frame, and an accordion edge suspension device for holding the voice coil in position within the frame; and a second speaker system coaxially aligned with and positioned within the first speaker system and including— a permanent magnet for producing a magnetic flux, the permanent magnet positioned within an upper portion of the center pole, a voice coil, a diaphragm driven by the voice coil, a baffle for directing the sound waves emanating from the diaphragm, wherein the baffle is circumferentially positioned around the diaphragm and within the center pole of the first speaker system, and a step-down ledge, circumferentially positioned adjacent to the lower surface of the baffle and extending outwardly from the baffle for reflecting sound waves emanating from the diaphragm of the second speaker system, such that a substantial portion of the sound waves do not reflect off of the diaphragm of the first speaker system.

11. In a speaker assembly comprising first and second speaker systems coaxially aligned, such that the second speaker system is positioned within the first speaker system, the first speaker system including a first diaphragm and the second speaker system including a second diaphragm and a baffle positioned proximate to the second diaphragm, wherein upon sound waves emanating from the second diaphragm, a first portion of the waves are directed outwards by the baffle, and a second portion of the waves are diffracted around an edge of the baffle, the improvement to the coaxial speaker assembly comprising:

a step-down ledge positioned adjacent to and substantially surrounding the baffle, such that the second portion of sound waves diffracted around the edge of the baffle reflect off of the step-down ledge and outwards away from the first diaphragm.

12. The step-down ledge as set forth in claim 11, wherein the second diaphragm of the second speaker system is circumferentially surrounded by the baffle.

* * * * *